US005348796A

United States Patent [19]

Ichibori et al.

[11] Patent Number: 5,348,796

[45] Date of Patent: * Sep. 20, 1994

[54] FLAME-RETARDED COMPOSITE FIBER

[75] Inventors: Keiji Ichibori, Akashi; Takaharu Matsumoto, Takasago; Youchi Kanbara, Kobe, all of Japan

[73] Assignee: Kanegafuchi Kogaku Kogyo Kabushiki Kaisha, Osaka, Japan

[ * ] Notice: The portion of the term of this patent subsequent to Sep. 5, 2006 has been disclaimed.

[21] Appl. No.: 42,192

[22] Filed: Apr. 2, 1993

Related U.S. Application Data

[60] Division of Ser. No. 771,900, Oct. 8, 1991, Pat. No. 5,208,105, which is a continuation of Ser. No. 385,620, Jul. 26, 1989, abandoned, which is a division of Ser. No. 147,089, Jan. 20, 1988, Pat. No. 4,863,797, which is a continuation of Ser. No. 783,502, Oct. 3, 1985, abandoned.

[30] Foreign Application Priority Data

Oct. 5, 1984 [JP] Japan ..... 59-209967
Nov. 19, 1984 [JP] Japan ..... 59-244130

[51] Int. Cl.[5] ..... D03D 3/00; D03D 15/00

[52] U.S. Cl. ..... 428/224; 428/225; 428/226; 428/240; 428/242; 428/280; 428/281; 428/283; 428/288; 428/292; 428/296; 428/372; 428/373; 428/921

[58] Field of Search ..... 428/357, 364, 372, 373, 428/359, 379, 224, 283, 288, 292

[56] References Cited

U.S. PATENT DOCUMENTS 3,193,602 7/1965 Leonard et al. ..... 264/192
3,271,344 9/1966 Lowes, Jr. ..... 260/29.6
3,748,302 7/1973 Jones ..... 260/41 B
3,763,644 10/1973 Jackson, Jr. et al. ..... 57/140 BY
3,874,155 4/1975 Knopka ..... 57/140 BY
3,874,157 4/1975 Knopka ..... 57/140 BY
3,900,666 8/1975 St. Mard et al. ..... 428/290
3,971,202 7/1976 Windley ..... 57/140 BY
4,059,546 11/1977 Knopka ..... 260/16
4,091,066 5/1978 Suzuki et al. ..... 264/182
4,127,698 11/1978 Shimizu et al. ..... 428/373
4,863,797 9/1989 Ichibori et al. ..... 428/359
5,208,105 5/1993 Ichibori et al. ..... 428/373

FOREIGN PATENT DOCUMENTS 2604826 8/1977 Fed. Rep. of Germany .
46-12096 3/1971 Japan .
5182022 7/1973 Japan .
48-73521 10/1973 Japan .
58-36208 3/1983 Japan .
60-110940 6/1985 Japan .

*Primary Examiner*—Patrick J. Ryan
*Assistant Examiner*—J. M. Gray
*Attorney, Agent, or Firm*—Armstrong, Westerman, Hattori, McLeland & Naughton

[57] ABSTRACT

A flame-retarded textile fabric comprising (A) 85 to 15 parts by weight of a fiber comprising a polymer containing 17 to 86% by weight of a halogen, and 6 to 50% by weight of an Sb compound based on the polymer, and (B) 15 to 85 parts by weight of at least one fiber selected from the group consisting of natural fibers and chemical fibers, the total amount of the fibers (A) and (B) being 100 parts by weight. The textile fiber has not only the desired flame resistance but also excellent visual feeling, feeling of touchness, hygroscopic property, washing resistance, durability, and the like.

13 Claims, 1 Drawing Sheet

FLAME-RETARDED COMPOSITE FIBER

This application is a division of application Ser. No. 771,900, filed Oct. 8, 1991, now U.S. Pat. No. 5,208,105, which is a continuation of application Ser. No. 385,620, filed Jul. 26, 1989, now abandoned, which is a division of application Ser. No. 147,089, filed Jan. 20, 1988, now U.S. Pat. No. 4,863,797, which is a continuation of application Ser. No. 06/783,502, filed Oct. 3, 1985, now abandoned.

BACKGROUND OF THE INVENTION

The present invention relates to a flame-retarded composite fiber composed of a halogen-containing fiber highly flame-retarded by a flame retardant and other fibers, and having an excellent feeling to the touch, hygroscopic property and flame resistance, and more particularly to a flame-retarded composite fiber prepared by blending a halogen-containing fiber having a large amount of an antimony compound (hereinafter referred to as "Sb compound") as a flame retardant and at least one fiber selected from the group consisting of natural fibers and chemical fibers.

Recently, it has been strongly required that textile goods are flame-retarded for use not only in interior goods but also in clothes and bedclothes, and moreover demands that the textile goods are excellent in properties other than the flame resistance such as visual attractiveness, feeling, hygroscopic property, washing resistance and durability are being increased.

The study for flame retarding of fibers has hitherto been carried out with respect to specific single-component fibers such as polyester fiber and viscose rayon fiber, including modacrylic fiber and polychlal fiber, and single-component fibers having an excellent flame resistance have been obtained. However, the single-component fibers cannot satisfy demands of consumers which diversify and seek a higher performance more and more. Accordingly, it is inevitably necessary that the flame-retarded fibers are blended or woven with other fibers, but there are a little studies for flame retarding of composite fibers wherein fibers of 2 or more kinds are blended.

For instance, there is described in Japanese Examined Patent Publication (Tokkyo Kokoku) No. 21612/1977 a composite fiber prepared by blending a phosphorus-containing polyester fiber with an acrylonitrile fiber, and there is described in Japanese Unexamined Patent Publication (Tokkyo Kokai) No. 6617/1978 a composite fiber prepared by blending a stannic acid and antimonic acid-containing polychlal fiber with polyester fiber, acrylic fiber, cotton, or the like. However, such composite fibers are not sufficient in flame resistance, feeling, hygroscopic property, and the like.

An object of the present invention is to provide a fiber satisfying the demands of consumers which diversify and seek higher flame resistance, visual attractiveness, feeling, hygroscopic property, washing resistance, durability, and the like.

The above and other objects of the present invention will become apparent from the description hereinafter.

SUMMARY OF THE INVENTION

It has now been found that when a fiber containing an Sb compound in large quantities and made of a halogen-containing polymer is blended with other inflammable fibers to produce a composite fiber, the the flame resistance is maintained high as compared with conventional flame resistant fibers.

In accordance with the present invention, there is provided a flame-retarded composite fiber comprising (A) 85 to 15 parts by weight of a fiber comprising a polymer containing 17 to 86% by weight of a halogen, and 6 to 50% by weight of an Sb compound based on the polymer, and (B) 15 to 85 parts by weight of at least one fiber selected from the group consisting of natural fibers and chemical fibers, the total amount of the fibers (A) and (B) being 100 parts by weight. The composite fiber of the invention has the desired high flame resistance and it satisfies demands of consumers which diversify and seek high visual attractiveness, feeling, hygroscopic property, washing resistance, durability, and the like.

DETAILED DESCRIPTION

Figure 1:
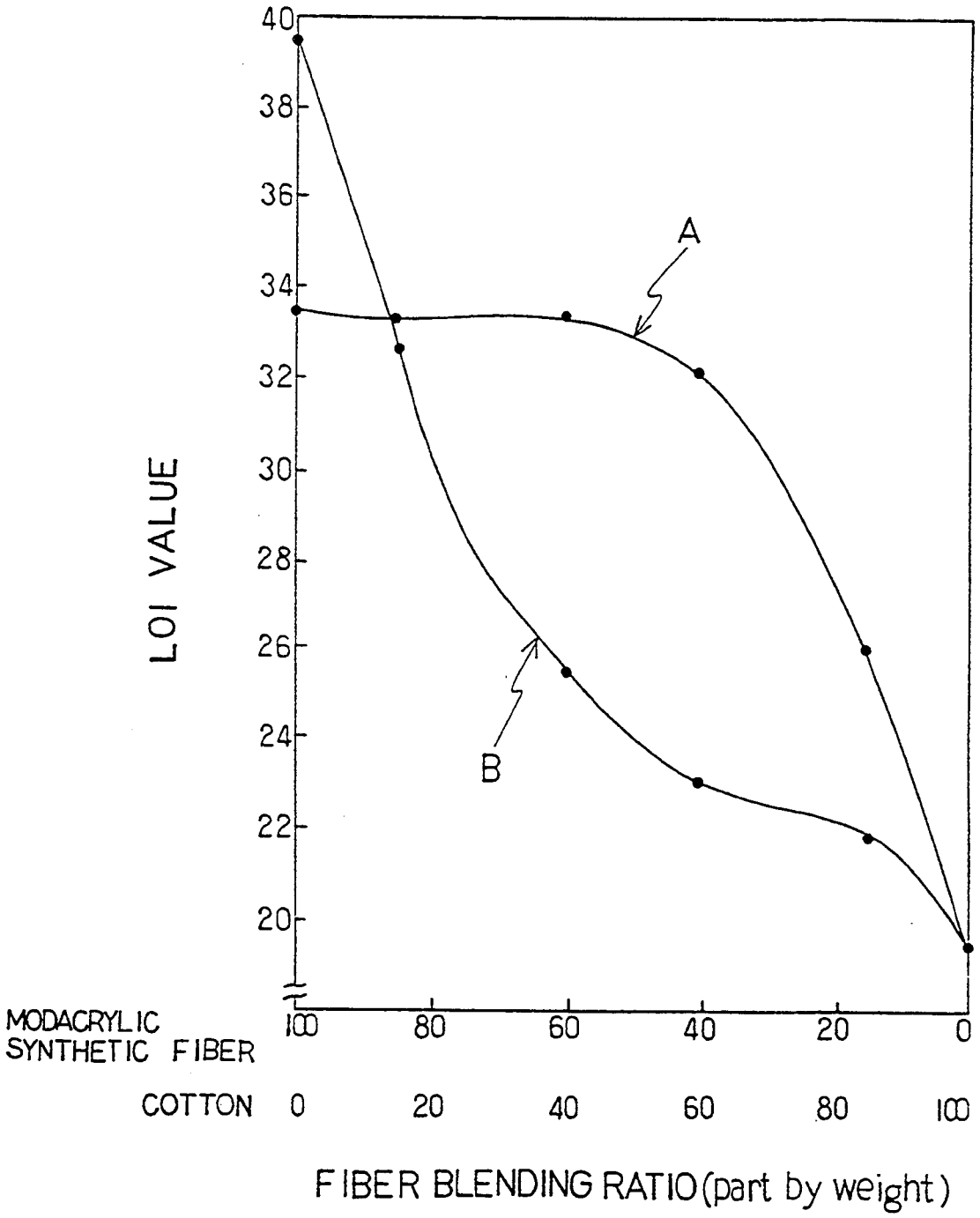
FIG. 1 is the graph showing a relationship between the fiber blending ratio and the limiting oxygen index value, wherein the curve (A) shows the results of flammability test for a composite fiber composed of a modacrylic fiber prepared in Preparation Example 1 and cotton, and the curve (B) shows the results of flammability test for a composite fiber composed of a modacrylic fiber prepared in Preparation Example 2 and cotton.

In the present invention, a fiber prepared from a composition containing a polymer containing 17 to 86% by weight, preferably 17 to 73% by weight, of a halogen, and 6 to 50% by weight of an Sb compound based on the polymer is employed.

The polymer containing 17 to 86% by weight of a halogen employed in the invention includes, for instance, a polymer of a halogen-containing monomer, a polymer to which a halogen-containing compound is added, a polymer impregnated with halogen by after-treatment of the polymer in the form of fiber, and the like.

Typical examples of such a halogen-containing polymer are, for instance, homopolymers or copolymers of halogen-containing vinyl monomers such as vinyl chloride, vinylidene chloride, vinyl bromide and vinylidene bromide; copolymers of a halogen-containing vinyl monomer and acrylonitrile such as acrylonitrile-vinylidene chloride, acrylonitrile-vinyl chloride, acrylonitrile-vinyl chloride-vinylidene chloride, acrylonitrile-vinyl bromide, acrylonitrile-vinylidene chloride-vinyl bromide, and acrylonitrile-vinyl chloride-vinyl bromide copolymers; copolymers of at least one halogen-containing vinyl monomer such as vinyl chloride, vinylidene chloride, vinyl bromide or vinylidene bromide, acrylonitrile and a vinyl compound copolymerizable with the halogen-containing vinyl monomer and acrylonitrile; acrylonitrile homopolymer to which a halogen-containing compound such as chloroparaffine, decabromodiphenyl ether, and brominated bisphenol A and derivatives is added; halogen-containing polyesters; polyester fibers obtained by impregnating with halogen-containing compound such as hexabromocyclododecane; and the like, but the halogen-containing polymers used in the invention are not limited thereto. The polymers may be employed alone or in admixture thereof.

Examples of the vinyl compound copolymerizable with the halogen-containing vinyl monomers and acrylonitrile are, for instance, acrylic acid and its esters, methacrylic acid and its esters, acrylic amide, methacrylic amide, vinyl acetate, vinyl sulfonic acid and its salts, methallyl sulfonic acid and its salts, styrene sulfonic acid and its salts, and the like. These vinyl compounds may be employed alone or in admixture thereof.

When the polymer containing 17 to 86% by weight of halogen is a copolymer of 30 to 70% by weight of acrylonitrile, 70 to 30% by weight of a halogen-containing vinyl monomer and 0 to 10% by weight of a vinyl monomer copolymerizable with acrylonitrile and the halogen-containing vinyl monomer, the obtained fiber has not only the desired flame resistance but also the feeling of acrylic fibers, and accordingly such a copolymer is preferably used. In that case, when at least one of the copolymerizable vinyl compounds used is a vinyl monomer containing a sulfonic acid group, the dyeability of the obtained fiber is increased.

When the halogen content in the halogen-containing polymer is less than 17% by weight, it is hard to impart the flame resistance to the fiber. On the other hand, when the halogen content is more than 86% by weight, the prepared fiber is not satisfactory in physical properties such as strength, elongation and heat resistance, dyeability, and feeling of touchness.

In the present invention, Sb compound is employed as a flame retardant. Examples of the Sb compound are, for instance, inorganic antimony compounds, e.g. antimony oxide such as $Sb_2O_3$, $Sb_2O_4$ or $Sb_2O_5$, antimonic acid, and antimony oxychloride, and the like, but the Sb compounds are not limited thereto. The Sb compounds may be employed alone or in admixture thereof.

The proportion of the Sb compound is from 6 to 50% by weight, preferably from 8 to 40% by weight, more preferably from 10 to 30% by weight, based on the polymer containing 17 to 86% by weight of halogen. When the proportion of the Sb compound is less than 6% by weight, it is necessary that the blending ratio of the fiber (A) composed of the Sb compound and the polymer containing 17 to 86% by weight of a halogen (hereinafter the fiber (A) being referred to as "halogen and Sb-containing fiber") in the flame-retarded composite fiber is increased for obtaining a flame-retarded composite fiber having a desired high flame resistance. However, in case of increasing the blending ratio of the halogen and Sb-containing fiber (A), the obtained flame-retarded composite fiber are not sufficient in performances other than flame resistance such as visual feeling, feeling of touchness, hygroscopic property, washing resistance and durability. On the other hand, when the proportion of the Sb compound is more than 50% by weight, troubles such as choking of a nozzle occur in the course of the preparation or the physical properties of the fiber such as strength and elongation are lowered, and consequently problems arise in preparation and quality of the halogen and Sb-containing fiber (A) .

In the present invention, other flame retardants may be employed together with the Sb compound so long as the proportion of the Sb compound in the fiber (A) is maintained within the range of 6 to 50% by weight based on the polymer containing 17 to 86% by weight of halogen.

Examples of the other flame retardant are, for instance, organic halogen compounds such as hexabromobenzene, decabromodiphenyl ether, brominated bisphenol A and derivatives thereof, and chlorinated paraffin; halogen-containing phosphorus compounds such as tris(2,3-dichloropropyl)phosphate; organic phosphorus compounds such as dibutylaminophosphate; inorganic phosphorus compounds such as polyammonium phosphate; inorganic magnesium compounds such as MgO, $Mg(OH)_2$ and $MgCO_3$; inorganic tin compounds such as stannic oxide, metastannic acid, stannous oxyhalide, stannic oxyhalide, and stannous hydroxide; inorganic aluminum compound such as $Al(OH)_3$; and the like. The other flame retardants are used in an amount of 0 to 10% by weight based on the halogen-containing polymer.

In the present invention, the flame-retarded composite fiber is prepared from 15 to 85 parts by weight of the halogen and Sb-containing fiber (A) and 85 to 15 parts by weight of at least one fiber (B) selected from the group consisting of natural fibers and chemical fibers, which are blended so that the total amount of the fibers (A) and (B) is 100 parts by weight.

The blending ratio of the halogen and Sb-containing fiber (A) and the fiber (B) is determined in accordance with the flame resistance required for the end products, and other desired properties such as visual feeling, feeling of touchness, hygroscopic property, washing resistance, durability, and the like of the end products. The blending ratio of the fiber (A) and the fiber (B) varies depending on the kinds and compositions of the halogen and Sb-containing fibers (A), kinds and amounts of the other flame retardants when used, and kinds of the fibers (B), and combination of the fiber (A) and fiber (B).

When the amount of the halogen and Sb-containing fibers (A) is less than 15 parts by weight, in other words, when the amount of the natural fibers and/or chemical fibers (B) is more than 85 parts by weight, the flame resistance of the obtained composite fibers is not sufficient. On the other hand, the amount of the halogen and Sb-containing fibers (A) is more than 85 parts by weight, in other words, when the amount of the natural fibers and/or chemical fibers (B) is less than 15 parts by weight, the flame resistance of the composite fibers is excellent, but the other properties such as visual feeling, feeling of touchness, hygroscopic property, washing resistance, and durability, are not sufficient.

It is more preferable that the amount of the halogen and Sb-containing fiber (A) is from 85 to 20 parts by weight and the amount of the natural and/or chemical fibers (B) is from 15 to 80 parts by weight, since the obtained flame-retarded composite fiber has the desired flame resistance and moreover markedly reveals the characteristics of the natural and/or chemical fibers (B).

The reason why the flame-retarded composite fiber of the invention has the excellent flame resistance is considered that since a large amount of the Sb compound which has a gas type flame resisting effect is included in the fiber (A), a noninflammable gas such as hydrogen halide, halogen and antimony halide is produced at a relatively low temperature and also a noninflammable decomposition product covers over inflammable fibers.

Examples of the natural fibers to be blended with the fiber (A) are, for instance, vegetable fibers such as cotton, flax and ramie, animal fibers such as sheep wool, camel hair, goat hair and silk, and the like. Examples of the chemical fiber to be blended with the fiber (A) are, for instance, regenerated fibers such as viscose rayon fibers and cuprammonium rayon fibers, semi-synthetic fibers such as cellulose acetate fibers, synthetic fibers such as nylon fibers, polyester fibers and acrylic fibers, and the like. These natural and chemical fibers are not limited to such examplified fibers. The natural and chemical fibers may be employed alone or in admixture thereof.

The halogen and Sb-containing fiber (A) employed in the present invention contains a large amount of the flame retarder such as inorganic metal compounds. The halogen and Sb-containing fiber (A) is prepared from a composition containing the Sb compound and the halogen-containing polymer. Usually, the flame retardant is added to an organic solvent solution of the halogen-containing polymer, and the mixture is spun by a usual spinning method. Preferably, the flame retardant is thoroughly ground by a vibrating mill to a particle size of at most 2 μm, whereby troubles in spinning such as choking of a nozzle or breaking of spinning fiber can be prevented.

The flame-retardant composite fiber of the invention can be prepared by various methods such that the fiber (A) and the fiber (B) are blended in the form of a staple sliver; the fiber (A) and the fiber (B) are twisted; or after spinning the fiber (A) and the fiber (B) respectively, the obtained yarns are woven. Also, when the fiber (A) and the fiber (B) are spun into a yarn, the composite fiber may be prepared in the form of a slub or nep, and a fiber, e.g. fiber (B), may be wound around the other fiber.

The term "fiber" as used herein means not only so-called filaments such as long filaments and short filaments but also textile goods such as yarns, woven fabrics, knitted fabrics and non-woven fabrics.

The flame-resistant composite fibers of the invention may optionally include an antistatic agent, an agent for preventing the heat-colaration, an agent for increasing the color fastness to light, an agent for increasing whiteness, an agent for preventing the lowering in luster, and other additives.

The thus obtained flame-resistant composite fiber of the invention has the desired flame resistance and also has the properties that the fibers (B) possess, such as visual feeling, feeling of touchness, hygroscopic property, washing resistance and durability.

The present invention is more specifically described and explained by means of the following Examples in which all percents and parts are by weight unless otherwise noted. It is to be understood that the present invention is not limited to the Examples, and various changes and modifications may be made in the invention without departing from the spirit and scope thereof.

In Examples, the flame resistance of a fiber was measured according to the limited oxygen index method (LOI method) as follows:

Flame resistance

Two grams of the blended fiber in the predetermined proportion is divided into 8 groups and 8 pieces of samples are prepared by twisting in a length of about 6 cm. Then, the sample is put in a holder of a limited oxygen index combustion tester in an erect posture. The sample is burnt, and the limited oxygen concentration necessary to keep burning by 5 cm is measured. The limited oxygen concentration is shown as LOI value. The larger the LOI value, the better the flame resistance.

The flame resistance has been generally measured and estimated in a textile state, but the flame resistance of the fiber itself cannot be estimated rightly from the measurement in the textile state, because the result varies depending on the number of twists, the thickness of a yarn or the density of pick, or the like. For such reason, the LOI method was adopted in order to rightly estimate the flame resistance of the fiber itself of the present invention.

PREPARATION EXAMPLE 1

A copolymer of 49.0% of acrylonitrile and 51.0% of vinyl chloride was dissolved in acetone to give a 27.0% solution. Antimony trioxide was added to a part of the above copolymer solution diluted with acetone to a volume of 3 times so that the total solid concentration was 50%, and then was dispersed in the solution by employing a vibrating mill. The dispersion was added to the above-mentioned copolymer solution in such a proportion that the antimony trioxide concentration was 20% based on the copolymer, and the dispersion and the copolymer solution were mixed to prepare a spinning solution.

The obtained spinning solution was extruded into a 30% aqueous solution of acetone through a nozzle having 300 holes and a hole diameter of 0.08 mm. After the formed filament was washed with water and was dried at 120° C., the filament was heat-drawn to increase the length of the filament three times. It was then heat-treated at 140° C. for 5 minutes to give a halogen and Sb-containing modacrylic fiber.

PREPARATION EXAMPLE 2

A modacrylic fiber was prepared in the same manner as in Preparation Example 1 except that a spinning solution containing 10% of, based on the copolymer, magnesium oxide was added instead of antimony trioxide.

EXAMPLES 1 TO 4 AND COMPARATIVE EXAMPLES 1 TO 9

Each of the halogen and Sb-containing modacrylic fiber prepared in Preparation Example 1 and the modacrylic fiber prepared in Preparation Example 2 was blended with cotton in a blending ratio shown in Table 1. A sample for use in a flammability test was prepared and the LOI value of the sample was measured.

The results are shown in Table 1 and FIG. 1.

Also, a sensory test was carried out as to whether the obtained composite fiber had a characters of cotton (visual feeling, feeling of touchness, and the like) or not.

The results are also shown in Table 1.

TABLE 1

| | Fiber blending ratio | | | | |
|---|---|---|---|---|---|
| | Modacrylic Fiber | | Cotton | LOI | Sensory |
| | Kind | Amount | Amount | value | test*1 |
| Ex. 1 | Fiber prepared in Pre. Ex. 1 | 85 | 15 | 33.3 | ○ |
| Ex. 2 | Fiber prepared in Pre. Ex. 1 | 60 | 40 | 33.3 | ○ |
| Ex. 3 | Fiber prepared in Pre. Ex. 1 | 40 | 60 | 32.1 | ○ |
| Ex. 4 | Fiber prepared in Pre. Ex. 1 | 15 | 85 | 25.8 | ○ |
| Com. Ex. 1 | Fiber prepared in Pre. Ex. 1 | 100 | 0 | 33.5 | X |
| Com. Ex. 2 | Fiber prepared in Pre. Ex. 1 | 90 | 10 | 33.4 | X |
| Com. Ex. 3 | Fiber prepared in Pre. Ex. 1 | 0 | 100 | 19.3 | ○ |
| Com. Ex. 4 | Fiber prepared in Pre. Ex. 2 | 100 | 0 | 39.5 | X |
| Com. Ex. 5 | Fiber prepared in Pre. Ex. 2 | 90 | 10 | 35.0 | X |
| Com. Ex. 6 | Fiber prepared in Pre. Ex. 2 | 85 | 15 | 32.6 | ○ |
| Com. | Fiber prepared | 60 | 40 | 25.5 | ○ |

TABLE 1-continued

| | Fiber blending ratio | | | | |
|---|---|---|---|---|---|
| | Modacrylic Fiber | | Cotton | LOI | Sensory |
| | Kind | Amount | Amount | value | test*1 |
| Ex. 7 | in Pre. Ex. 2 | | | | |
| Com. | Fiber prepared | 40 | 60 | 23.0 | ○ |
| Ex. 8 | in Pre. Ex. 2 | | | | |
| Com. | Fiber prepared | 15 | 85 | 21.8 | ○ |
| Ex. 9 | in Pre. Ex. 2 | | | | |

(Note)
*1Estimation
○: Fiber has characters of cotton.
X: Fiber has no characters of cotton.

From the results of Table 1 and FIG. 1, it is observed that the flame resistance of the modacrylic fiber itself prepared in Preparation Example 2 is higher than the flame resistance of the halogen and Sb-containing modacrylic fiber itself prepared in Preparation Example 1 and used in the present invention. However, comparing the composite fibers, the degree of lowering in the flame resistance of the halogen and Sb-containing modacrylic fiber according to the present invention is smaller than the modacrylic fiber prepared in Preparation Example 2. Also, when the content of cotton in the composite fiber is at least 15 parts, the composite fibers of the Examples according to the present invention show a high LOI value and are superior in flame resistance to the composite fibers of the Comparative Examples.

EXAMPLE 5 AND COMPARATIVE EXAMPLE 10

There were mixed 70 parts of the modacrylic fiber prepared in Preparation Example 1 and 30 parts of cotton, and the mixed fiber was spun into spun yarn (ECC 30/2). The obtained yarns were woven to give test cloths of plain fabrics (the number of warps: 50 yarns/inch, the number of wefts: 30 yarns/inch, 40 yarns/inch or 50 yarns/inch) (Example 5 ).

The above-mentioned procedure was repeated except that the modacrylic fiber prepared in Preparation Example 2 was employed instead of the Sb-containing modacrylic fiber, to give test cloths (Comparative Example 10).

The obtained test cloths were subjected to a flame test according to the method provided in the Fire Services Act.

The results of the test were that the cloth prepared by using the fiber prepared in Preparation Example 1 (Example 5) came up to the standard, but the cloth prepared by using the fiber prepared in Preparation Example 2 (Comparative Example 10) came below the standard.

PREPARATION EXAMPLES 3 TO 9

A copolymer of 50% of acrylonitrile, 34% of vinyl chloride, 15% of vinylidene chloride and 1.0% of sodium methallylsulfonate was dissolved in dimethylformamido in a copolymer concentration of 25%.

A dispersion of antimony trioxide prepared in the same manner as in Preparation Example 1 was added to the obtained solution to give a spinning solution containing antimony trioxide in an amount of 0% (Preparation Example 3), 2% (Preparation Example 4), 6% (Preparation Example 5), 10% (Preparation Example 6), 20% (Preparation Example 7), 50% (Preparation Example 8) or 70% (Preparation Example 9) based on the copolymer.

A modacrylic fiber was prepared in the same manner as in Preparation Example 1 except that the spinning solution was extruded in a 60% aqueous solution of dimethylformamido.

The spinning solution of Preparation Example 9 caused choking of nozzle and breaking of spinning fiber, but other spinning solutions did not cause troubles.

EXAMPLES 6 TO 9 AND COMPARATIVE EXAMPLES 11 TO 13

There were mixed 50 parts of each of the modacrylic fibers prepared in Preparation Examples 3 to 9 and 50 parts of cotton to give a composite fiber.

The LOI value of the obtained composite fiber and the LOI value of the modacrylic fiber itself were measured and compared the lowering of the LOI value of the composite fiber from the LOI value of the modacrylic fiber are shown in Table 2.

TABLE 2

| | Modacrylic fiber | | |
|---|---|---|---|
| | Kind | Content of antimony trioxide (%) | Lowering of LOI valu |
| Ex. 6 | Fiber prepared in Pre. Ex. 5 | 6 | 3.3 |
| Ex. 7 | Fiber prepared in Pre. Ex. 6 | 10 | 1.5 |
| Ex. 8 | Fiber prepared in Pre. Ex. 7 | 20 | 0.3 |
| Ex. 9 | Fiber prepared in Pre. Ex. 8 | 50 | 0.2 |
| Com. Ex. 11 | Fiber prepared in Pre. Ex. 3 | 0 | 7.2 |
| Com. Ex. 12 | Fiber prepared in Pre. Ex. 4 | 2 | 6.5 |
| Com. Ex. 13 | Fiber prepared in Pre. Ex. 9 | 70 | 0 |

From the result of Table 2, it is observed that the degree of the lowering of the LOI value is small when the amount of antimony trioxide is not less than 6% (the fibers prepared in Preparation Examples 5 to 9). On the other hand, when the amount of antimony trioxide is more than 70%, the spinning solution causes troubles in spinning such as choking of nozzle and breaking of spinning fiber.

EXAMPLE 10

There were mixed 60 parts of the modacrylic fiber containing 20% of antimony trioxide based on the copolymer, which was prepared in Preparation Example 7, and 40 parts of a fiber shown in Table 3 to give a composite fiber.

The LOI value of the obtained composite fiber and the LOI value of the modacrylic fiber itself were measured, and the difference between them were obtained. The decrease of the LOI value of the composite fiber from the LOI value of the modacrylic fiber are shown in Table 3.

COMPARATIVE EXAMPLE 14

The procedure of Preparation Example 7 was repeated except that a metastannic acid was employed in an amount of 20% based on the polymer instead of the antimony trioxide.

The composite fiber was prepared in the same manner as in Example 10 except that the obtained modacrylic fiber was employed.

The LOI value of the obtained composite fiber and the LOI value of the modacrylic fiber itself were measured. The difference between them were obtained. The decrease of the LOI value of the composite fiber from the LOI value of the modacrylic fiber are shown in Table 3.

TABLE 3

| Fiber mixed with modacrylic fiber | Lowering of LOI value | |
|---|---|---|
| | Example 10 | Comparative Example 14 |
| Cotton | 0.4 | 13.2 |
| Linen | 0.0 | 9.2 |
| Ramie | 1.5 | 8.6 |
| Wool | 2.0 | 9.3 |
| Viscose rayon fiber | 1.1 | 8.5 |
| Polyester fiber | 2.6 | 11.5 |
| Flame-retarded polyester fiber | 2.4 | 12.0 |
| Acrylic fiber | 2.8 | 10.1 |

From the result of Table 3, it is recognized that the lowering of LOI values of the composite fibers composed of the modacrylic fiber prepared in Preparation Example 7 and other fibers (Example 10) is smaller than the lowering of LOI values of the composite fibers of the Comparative Example 14.

The flame-resistant composite fiber of the invention has the desired flame resistance and moreover has excellent properties which are hard to be obtained from one-component flame-resistant fibers, such as visual attractiveness, feeling, hygroscopic property, washing resistance and durability. Accordingly, the textile goods prepared from the flame-retarded composite fiber of the present invention, for instance, interior goods, clothes, bedclothes, and the like can satisfy the demands of consumers which diversify and seek a higher performance.

What we claim is:

1. A textile fabric comprising (A) 85-15 parts by weight of a fiber consisting essentially of (1) a polymer having a halogen content of 17 to 86% by weight and (2) a flame retardant comprising 8 to 40% by weight of an Sb compound based on said polymer, and (B) 15-85 parts by weight of at least one fiber selected from the group consisting of natural fibers and chemical fibers, wherein the total amount of fibers (A) and (B) is 100 parts by weight, and said polymer is at least one polymer selected from the group consisting of a polymer of a halogen-containing vinyl monomer, and a polymer to which a halogen-containing compound is added, said fibers being formed into a fabric.

2. A textile fabric according to claim 1, wherein said fabric is a woven fabric.

3. A textile fabric according to claim 1, wherein said fabric is a knitted fabric.

4. A textile fabric according to claim 1, wherein said fabric is a non-woven fabric.

5. A textile fabric according to claim 1, wherein said polymer of a halogen-containing vinyl monomer is a polymer selected from the group consisting of a homopolymer of a halogen-containing vinyl monomer, a copolymer of a halogen-containing vinyl monomer and at least one other vinyl monomer copolymerizable therewith, a copolymer of a halogen-containing vinyl monomer and acrylonitrile, and a copolymer of a halogen-containing vinyl monomer, acrylonitrile and a vinyl compound copolymerizable with the vinyl monomer and the acrylonitrile.

6. A textile fabric according to claim 1, wherein said polymer is an acrylonitrile polymer.

7. A textile fabric according to claim 1, wherein said polymer is a vinylidene polymer.

8. A textile fabric according to claim 7, wherein said vinylidene polymer is a polymer selected from the group consisting of a vinylidene chloride homopolymer, and acrylonitrile-vinylidene chloride copolymer, and acrylonitrile-vinyl chloride-vinylidene chloride polymer, a polymer of vinylidene chloride with acrylonitrile and a vinyl monomer copolymerizable with said vinylidene chloride and acrylonitrile.

9. A textile fabric according to claim 1, wherein said flame retardant comprises 8 to 40% by weight of a Sb compound and 0 to 10% by weight of another flame retardant other than the Sb compound, based on said polymer.

10. A textile fabric according to claim 7, wherein said other flame retardant is at least one member selected from the group consisting of an organic halogen compound, a halogen-containing phosphorus compound, an organic phosphorus compound, an inorganic phosphorus compound, an inorganic magnesium compound, an inorganic tin compound and an inorganic aluminum compound.

11. A textile fabric according to claim 1, wherein said flame retardant consists of 8 to 40% by weight of an Sb compound based on said polymer.

12. A textile fabric according to claim 1, wherein said halogen-containing vinyl monomer is at least one monomer selected from the group consisting of a vinyl halide and a vinylidene halide.

13. A textile fabric according to claim 1, wherein said polymer is at least one polymer selected from the group consisting of a copolymer of acrylonitrile and vinyl chloride, a copolymer of acrylonitrile and vinylidene chloride and a copolymer of acrylonitrile, vinyl chloride and vinylidene chloride.

* * * * *